United States Patent [19]

Rebhan

[11] Patent Number: 4,516,878

[45] Date of Patent: May 14, 1985

[54] TUNNEL CONSTRUCTING

[75] Inventor: Dieter Rebhan, Gelting, Fed. Rep. of Germany

[73] Assignee: Linde Aktiengesellschaft, Wiesbaden, Fed. Rep. of Germany

[21] Appl. No.: 425,200

[22] Filed: Sep. 28, 1982

[30] Foreign Application Priority Data

Oct. 13, 1981 [DE] Fed. Rep. of Germany ..... 3140672

[51] Int. Cl.[3] ..... E02D 19/14; E21D 1/06; E21D 9/00

[52] U.S. Cl. ..... 405/130; 405/132; 405/138; 175/17; 175/53; 175/62

[58] Field of Search ..... 405/130, 132, 134, 135, 405/137–139; 175/17, 53, 62

[56] References Cited

U.S. PATENT DOCUMENTS

| | | | |
|---|---|---|---|
| 340,162 | 4/1886 | Sooysmith | 405/132 X |
| 713,519 | 11/1902 | Sooysmith | 405/130 |
| 713,521 | 11/1902 | Sooysmith | 405/132 |
| 736,308 | 8/1903 | Sooysmith | 405/130 |
| 2,154,233 | 4/1939 | Donaldson | 405/137 |
| 3,183,675 | 5/1965 | Schroeder | 405/130 X |
| 3,491,843 | 1/1970 | Rodriguez | 175/53 |
| 3,528,252 | 9/1970 | Gail | 405/130 |
| 3,720,065 | 3/1973 | Sherard | 175/17 X |
| 3,726,095 | 4/1973 | Ross | 405/130 |

FOREIGN PATENT DOCUMENTS

| | | | |
|---|---|---|---|
| 628313 | 10/1978 | U.S.S.R. | 405/138 |

*Primary Examiner*—Cornelius J. Husar
*Assistant Examiner*—Nancy J. Stodola
*Attorney, Agent, or Firm*—James C. Wray

[57] ABSTRACT

Tunnels are constructed by freezing soil and removing frozen soil between starting and end shafts of the tunnels. Tunnels are driven in an uncomplicated manner in rapidly changing soils without auxiliary construction means. A hole is bored in or near the planned axis of the intended tunnel between starting and end shafts. A soil freezing work pipe is inserted into the hole. The pipe is cooled by a cooling agent. The soil freezing work pipe continues to be cooled until an ice and frozen soil mass has formed around the work pipe, which frozen mass has a diameter which is larger than that of the planned tunnel. Frozen soil is subsequently excavated, leaving a frozen soil lining, which is immediately supported by a primary support lining or a permanent lining.

3 Claims, 1 Drawing Figure

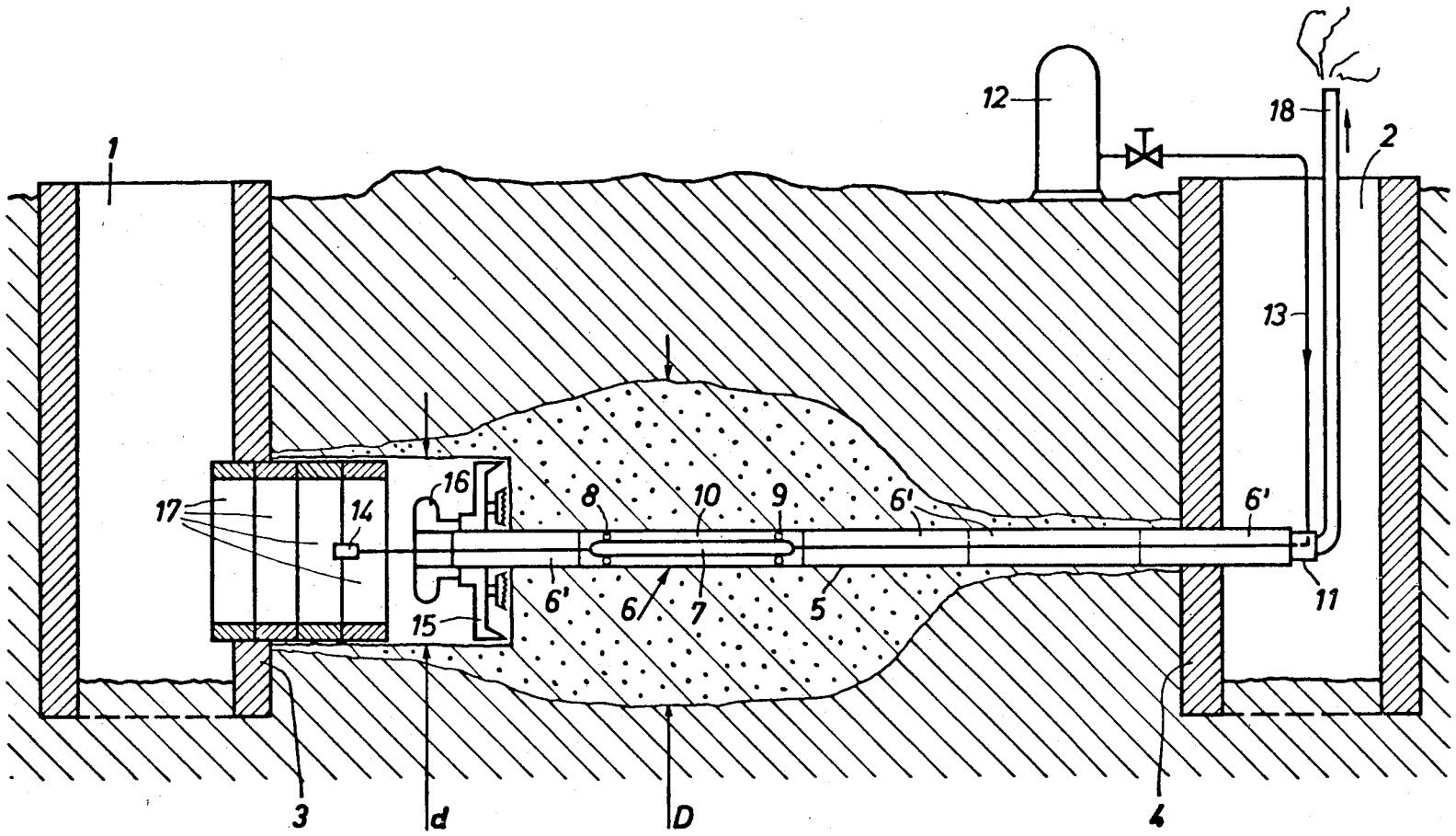
2
18
13
11
6'
4
12
6'
5
9
10
7
D
6
8
6'
16
15
d
14
3
17
1

TUNNEL CONSTRUCTING

BACKGROUND OF THE INVENTION

This invention relates to methods for constructing tunnels and particularly for constructing tunnels between starting shafts and end shafts.

A variety of methods are known for tunnel construction. The methods of tunnels advance and the optimal equipment selection primarily are determined by the intended use, the cross-section and the lining required, as well as by the prevailing rock or soil types. Of utmost importance are the criteria of costs and safety of the personnel driving the tunnel and costs and safety of the tunnel project itself, particularly when encountering difficult terrain.

A conventional method which is used in loose soils and loose rocks employs so-called poling plates or spiles and provides that soil is shored up before excavation is begun. However, tunnel driving with poling plates cannot, or at best, only partially can be employed in soils which have shallow consistencies or in soils which are under water pressure. Moreover, deformations of the poling plates or deviations of the excavating equipment present great difficulties.

The shield method of tunneling is a semi-mechanical method. It is suitable for use in driving tunnels having large cross-sections, both in dry soils and in soils under water, using compressed air. The shield, a large pipe-like construction made of steel, engages the face side of the tunnel with its front cutting edge. Powerful jacks drive the shield forward, cutting the tunnel shape while maintaining the cross section. Breasting of the face is provided as required. A lining is formed immediately behind the shield. Segmental or tubular portions of the lining are made of cast iron, steel or precast concrete and are installed under the protection of the rear portion of the shield, the shield tail. The shield-advancing jacks are supported against the lining. Shields are used in clay, sand and gravel. The shield driving method finds only marginal application if larger hard rock inclusions are encountered.

A variation thereof is compressed air shielding, which is employed in the presence of ground water. This very costly process is applied only if lowering of ground water is not possible. Limits of compressed air shielding, as in normal shield driving, are well defined. Furthermore, tunnels cannot be driven by compressed air shielding in changing soils or pervious soils with thin overlying ground, due to possible blow-out.

In addition to shield driving, there are driving methods which partly employ additional auxiliary construction equipment when dealing with difficult soils. For example, tunnel construction methods use gunite, shotcrete, injection grouting, drawing off or lowering ground water or surface freezing, etc. All of these procedures are more or less conditionally applicable depending upon soil, water content, consistency, tunnel cross section, overlying ground and total costs.

When constructing a tunnel by soil freezing, bore holes are drilled parallel to the tunnel axis at certain intervals beyond the planned outer limits of the tunnel. Pipes are inserted into these bore holes, and a cooling agent is circulated in the pipes. The cooling agent removes heat from the ground, until a frozen soil and ice mass is formed around the planned tunnel cross section. The ice mass supports the surrounding ground during excavation and protects the tunnel space already driven against ground water and cave-in.

The costs of the latter process are relatively high for forming the ice mass and maintaining its operation. Other conventional processes have significant technical drawbacks. In tunnel structures near the surface which are to be constructed in vastly varying soils, and in cases where water seepage may occur, shielding by soil freezing can be employed only in conjunction with auxiliary construction equipment. The auxiliary construction equipment, as a rule, presents a considerable environmental burden and frequently is permitted only if there are no technical alternatives and if the particular project absolutely has to go forward.

SUMMARY OF THE INVENTION

The invention provides methods for constructing tunnels using soil freezing in which tunnels can be driven in rapidly changing soils in uncomplicated manners without the aid of auxiliary construction equipment.

This objective is achieved by drilling a bore hole between starting and end shafts along the planned axis of the tunnel to be advanced, or in close proximity thereto. A ground freezing work pipe is inserted into the formed bore hole. The pipe is then cooled by a cooling agent until there is formed around the pipe a frozen soil and ice mass having a diameter which is larger than the cross-section of the planned tunnel. Subsequently, the frozen soil is excavated.

As in every other tunneling method such as those using poling plates or driven shields, the inventive process requires starting and end shafts which may be of varying sizes. Cooling agent is passed through the ground freezing work pipe until a sufficient frozen soil and ice mass have formed around the pipe. In cross section the frozen body is essentially circular. The ice mass has a size such that after constructing the tunnel cavity an ice wall of annular section remains. This remaining ice wall serves to seal against inrushes of water and also serves the purpose of support for the safety of the tunnel cavity and the personnel working therein.

The soil around the freezing work pipe is removed in frozen condition. The new method creates workable soil which, because of its uniformity, can be worked without technical difficulties. The ice mass provides the tunnel with support in both radial and axial directions, permitting excavating without ground disturbance. The tunnel is always driven into a frozen soil ahd ice mass which is circular in section. An annular ice wall always remains. The method of the invention offers a safe, temporary support until such time as the primary support lining has been placed, or until a permanent lining has been installed.

The present method permits tunnel driving which is independent of the depth of the tunnel and which can be used in rapidly changing soils. Specifically, the present tunnel driving methods provide a friendly environment in which to work without compressed air or other auxiliary construction means in ground water and in running ground or in flowing ground conditions.

In a particularly cost-effective variation of the present invention, the frozen body of ground is formed in axial sections. In this variation, the frozen body is always formed in only a part of the ground between the starting and end shafts. Sectional forming of the frozen body lowers energy costs considerably in comparison to the method in which the frozen body is formed along an entire tunnel length, i.e., in this case, between the starting and end shafts. To form ice masses in several sections one may work, for example, with freezer work pipes which are subdivided into sections which are later removed one by one. Freezing in sections is also accomplished by inserting an internal pipe into the soil freezing work pipe. A liquid-tight space is formed between the soil freezing work pipe and the internal pipe by flexible formable seals in an area of the ground to be frozen. A heat conducting freezing agent is introduced into the space between the seals. The heat conducting freezing agent is in heat exchange with a cooled fluid, which is introduced subsequently in the internal pipe. In another method, an internal pipe is introduced into the soil freezing work pipe, and the internal pipe is equipped with a heat insulating layer for part of its length.

Each of the methods described permits forming of the frozen soil and ice mass in segments. Depending on the course of the advance, the frozen mass is formed initially in the area of the starting shaft, in which the tunnel driving is initiated. Subsequent soil freezing and formation of the frozen mass in further sections is dependent upon the progressing of the work, essentially upon the excavation of the frozen soid around the soil freezing work pipe.

In another advantageous variation of the invention, liquid gases with low boiling points, such as liquid nitrogen, are used as cooling fluids. These gases extract considerable heat quantities because of their low boiling points. Liquid nitrogen is particularly suitable as a low boiling liquid as it is inexpensive. It cools rapidly due to its low boiling point, and liquid nitrogen is easy to handle. Brine can also be employed as a cooling agent.

Fundamentally, the soil freezing work pipes can be inserted into the hollow drill pipes between the starting and end shafts. Subsequently the drill pipes can be withdrawn. However, in a particularly advantageous variation of the invention, the drill pipes themselves are designed as soil freezer work pipes. Therefore, the drill pipes do not have to be withdrawn but can remain in the ground, thus forming the tunnel axis.

Still another advantageous variation of the invention constructs tunnels with large cross sections. According to the intended tunnel cross section, several holes are drilled between the starting and end shafts. Freezer work pipes are inserted into all holes. In this variation, not only one freezer work pipe is placed, but, depending on tunnel cross-section and profile, several freezer work pipes are placed in a parallel manner or step wise side by side. The number and arrangement of the freezer work pipes are determined by the tunnel cross sectional area and tunnel geometry.

All conventional excavation methods have in common that they have to be carried out either by manual processes or that they require equipment which is supported in the back to absorb the reaction forces which are caused by the feed pressure of the tools at the working face. According to a particularly advantageous variation of the invention, the frozen ground is excavated by an excavating device supported against axially reactive movement by the freezer work pipe. When several freezer work pipes are placed in large tunnel sections, according to the invention, there likewise will be several excavating devices, which work in parallel or step wise side by side. The freezer work pipes in these methods absorb the reaction forces and also simultaneously serve as guide elements for the excavating devices. The positioning or surveying, respectively, and exact insertion of the freezer work pipes thus determine the actual deviation of the tunnel drive, which requires no further monitoring.

In preferred embodiments, the outside of the freezer work pipe is equipped with a thread, rack or similar structure, which serves as a guide and abutment for the advance of the excavating device. In line with common drilling engineering practices, the freezer work pipe consists of pieces of varying lengths so that during excavating advance freed end sections can be removed and later can be reused.

In this variation, the freezer work pipe is required to be under tension as it has to absorb high reactive forces. Experience has shown, however, that accidental removal of the freezer working pipe from the construction soil is not possible as long as the freezing preceding the excavating forms a sufficient abutment and anchor for the pipe.

The excavating device itself can be designed completely to respond to the requirements of rapid and economic excavation of the frozen soil. Excavation, loading and transportation of the construction soil can be effected fully automatically—centered by the freeze working pipe—by hammer, chisel, milling cutter or similar cutters or combinations of tools. The axial portion of the freeze working pipe further offers the possibility of employing a rotating device which, for example, eats into the frozen soil in a step by step or sequential motion aided by the rack on the freeze working pipe. Aided by a thread on an alternate pipe, the cutter helically eats into the frozen soil. Hydro or thermal excavation processes are also possible. Excavation can be followed immediately by lining with primary blown or injected concrete or final linings such as extruded or reinforced concrete.

Depending upon the diameter of the freezer work pipe, the inventive method can achieve frozen wall diameters of up to about 5 m. The present method, therefore, is especially advantageous in tunnel construction with relatively small diameters. For larger tunnel cross sections, several freezer work pipes may be arranged at corresponding intervals within the excavation profile so that frozen bodies are formed which are of sufficient size to overlap each other, and which simultaneously or sequentially can be excavated with several cutters.

These and other and further features and objects of the invention are apparent in the disclosure, which includes the specification with the above and ongoing description and claims and drawing.

BRIEF DESCRIPTION OF THE DRAWINGS

The drawing is a schematic sectional elevational view of the embodiment of the tunneling system of the invention.

DETAILED DESCRIPTION OF THE DRAWINGS

The following is an explanation of the inventive method employing a soil freezing work pipe by way of an example, depicted in the schematic drawing.

In the process of driving a tunnel, access starting shaft 1 with shaft wall 3, and end shaft 2 with shaft wall 4 have been excavated. A drill pipe has been driven between shaft 1 and shaft 2. The drill pipe is designed as a soil freezing work pipe, and, therefore, remains in drill hole 5 upon completion of the boring. Freezer work pipe 6 in the example consists of several segments 6'. The segments, are connected with each other, for example, by way of external threads and appropriate bushings with internal threads. The outer sides of segments 6' carry rack 9. Slidable internal pipe 7 is inserted into the freezer work pipe. This internal pipe serves to facilitate freezing of the soil around the freezer work pipe by sections between the starting and end shafts. The tip of the internal pipe, as depicted in the drawing, has a diameter which is larger than its remaining portion. The remaining interior pipe extends between the interior pipe tip, and, for instance, end shaft 2. On both ends of the part of the internal pipe with the larger diameter there are two rubber seals 8, 9 along the circumference of the internal pipe. These rubber seals can be operated by compressed air so that they press against the interior wall of the freezer work pipe and create a water tight contact. Water is introduced into chamber 10 between the internal pipe and freeze work pipe 6, between seals 8 and 9 respectively. For example, water may be flowed into the space between seals 8 and 9 via the inner pipe 7 or through a separate pipe. Subsequently, a liquified low boiling gas, for example liquified nitrogen, is introduced into the internal pipe. The water contained by the rubber seals in annular space 10 is frozen in direct heat exchange and thus creates a good thermal bridge between internal pipe 7 and freezer work pipe 6 and the soil. Before sliding the internal pipe, annular space 10 is thawed by warm water or steam. The water or steam may be flowed through pipe 6 or pipe 7 or another pipe. The air is released from seals 8 and 9 and the internal pipe is adjusted longitudinally from end shaft 2.

In the end shaft 2, there is an infeed head 11 via which liquid nitorgen is introduced into internal pipe 7. In the example, the liquid nitrogen to be introduced into internal pipe 7 is taken from storage tank 12 via line 13, which may be vacuum insulated, and is passed through in feed head 11 into internal pipe 7. The nitrogen, released via the internal pipe 7 is evaporated in heat exchange with the soil, is returned via the feed element 11 and line 18, and is passed off to the atmosphere. From end shaft 2, the air or water required, respectively, are guided to the internal pipe tip.

On the side of the internal pipe tip facing the starting shaft 1, there is device 14 with which the position of the internal pipe, and inherently that of the area to be frozen, can be determined.

The internal pipe can be one or two pipes, in the latter case concentric. Liquid nitrogen flows inward in inner pipe 7. It is expanded in the enlarged area taking heat from the freezing agent between the seals. Nitrogen gas then flows out through pipe 6.

Initially, the area of the planned tunnel immediately adjacent the starting shaft 1 is frozen. Once an ice wall has formed with a sufficiently large diameter D, which is larger than diameter d of the planned tunnel, excavation of the first phase can commence. In the example, there is used a rotary excavating device 15, which rotates around the freezer work pipe 6, and which has a diameter adapted to the planned tunnel diameter. To put the excavating device into rotation and forward movement, there is provided a drive 16 which supports itself against axial movement on the freezer work pipe. Drive 16 advances excavating device 15 sequentially towards the frozen soil mass. Immediately upon completing excavation, cylindrical sections 17 of the tunnel lining can be placed. For example, there may be used for this purpose an erector which is rotatable around the axis of the excavating device. The space between the lining and the soil is injected with cement mortar. At this point at the latest, the internal pipe is moved to the next tunnel segment, and the surrounding soil is frozen. The invention provides that freezing always precedes excavating in such a way that a sufficient anchoring by soil freezing is provided for the freezer work pipe to absorb the axial reaction forces generated by drive 16.

In summary, the following advantages can be attributed to the inventive process:

1. Tunnels are driven independently of depth.
2. Soil is prepared for excavation so that due to its uniformity it can be excavated in a manner which is both time-effective and free of technical difficulties. Breasting is not required; running or flowing is prevented by the frozen face.
3. A safe temporary radial support is provided by the frozen periphery until a permanent lining is installed.
4. There is a low cost requirement for underground equipment.
5. The operation lends itself to few disturbances and easy repair.
6. There is required only very simple control which produces an inherently high degree of safety.
7. Work can be performed in a friendly environment in the absence of compressed air and auxiliary construction measures in ground water conditions.

While the invention has been described with reference to specific embodiments, modifications and variations may be employed without departing from the scope of the invention, which is defined in the following claims.

I claim:

1. A method of constructing a horizontal tunnel between two vertical shafts comprising the steps of (1) driving a drill pipe between the two vertical shafts thereby interconnecting the two vertical shafts and leaving the drill pipe in place after drilling, the drill pipe comprising a plurality of axially aligned segments being screw-threaded to each other, (2) slidably inserting an internal pipe into the drill pipe, the internal pipe having an enlarged diameter portion near an end thereof, the enlarged portion being provided with annular rubber seals at its opposite ends which engage the inner cylindrical surface of the drill pipe to create a watertight chamber between the annular rubber seals, the enlarged diameter portion further being approximately equal in length to a pipe segment, (3) introducing water into the chamber, (4) introducing a freezing liquid into the internal pipe to freeze the water contained within the chamber thereby creating a thermal bridge between the internal pipe and the drill pipe which facilitates freezing the ground in segments surrounding the drill pipe, the freeze area being greater in diameter than the tunnel, (5) thawing the water in the chamber, (6) releasing evaporated freezing liquid through conduit to the atmosphere, (7) providing rotary excavating means on one end of the drill pipe, the excavating means being supported on the outer surface of the drill pipe, (8) rotating and axially advancing the excavating means sequentially toward the enlarged diameter portion of the drill pipe to remove frozen soil.

2. The process of claim 1 further comprising the step of placing cylindrical tunnel lining members in an excavated area.

3. The process of claim 1 further comprising the step of moving the internal pipe axially away from the excavating means approximately the length of a pipe segment and repeating steps 3, 4, 5, 6, 7 and 8 so that a localized and sequential freezing and excavating of soil occurs.

* * * * *